United States Patent [19]

Abernethy et al.

[11] 4,135,115

[45] Jan. 16, 1979

[54] WATTAGE REDUCING DEVICE FOR FLUORESCENT FIXTURES

[76] Inventors: Robert R. Abernethy, 7295 Walton Rd., Walton Hills, Ohio 44146; James G. Bishop, 19229 Briarwood Ln., Strongsville, Ohio 44136

[21] Appl. No.: 789,548

[22] Filed: Apr. 21, 1977

[51] Int. Cl.[2] ..... H05B 41/16

[52] U.S. Cl. ..... 315/97; 315/187; 315/239; 315/245; 315/254; 315/324; 315/DIG. 5

[58] Field of Search ..... 315/95-98, 315/105, 185 R, 187, 227 R, 228, 231, 239, 245, 254, 312, 324, DIG. 5

[56] References Cited

U.S. PATENT DOCUMENTS

| | | | |
|---|---|---|---|
| 3,089,980 | 5/1963 | Neusbaum | 315/278 X |
| 3,176,187 | 3/1965 | Sola | 315/278 X |
| 3,954,316 | 5/1976 | Luchetta | 315/96 |

*Primary Examiner*—Eugene R. LaRoche

[57] ABSTRACT

A device which is designed to save electrical energy expended by a regular rapid start fluorescent lighting fixture having a plurality of lamps, or tubes, and a conventional ballast. The device comprises the combination of a step-up transformer, a resistor and two capacitors, all of which are mounted externally of the ballast. The device is wired in series with the ballast and one of the lamps to allow normal ballast voltages to be delivered to the lamp circuit, thereby eliminating any detrimental effects to the lamps or ballast. At the same time, the current to the lamps and consequent consumption of power by the lamps is substantially reduced to save electrical energy while providing a reduced, but uniform level of illumination.

11 Claims, 4 Drawing Figures

WATTAGE REDUCING DEVICE FOR FLUORESCENT FIXTURES

BACKGROUND OF THE INVENTION

The invention is designed for use with a conventional rapid start fluorescent lighting fixture which has a plurality of tubes or lamps and employs a standard series-type ballast, e.g., one that is manufactured in accordance with specifications of the American National Standards Institute (ANSI). More particularly, the invention saves on the electrical energy normally required by such fixtures which are widely used in the illumination of industrial and commercial buildings. With the large amount of energy spent daily for lighting, there is great potential for energy conservation.

Attempts are presently made to conserve electrical energy consumed by a series of fluorescent lighting fixtures of a particular system of illumination by discriminately operating only a portion of the fixtures, or by the removal of lamps from the fixtures to drastically reduce the illumination of the fixtures. The results are usually unsatisfactory, since the design of the lighting system is radically altered, thereby resulting in spotty and uneven patterns of illumination. Moreover, the aesthetic appearance of the lighting fixtures is diminished and sometimes destroyed by the removal of any of the lamps.

As a solution to this problem, some manufacturers of fluorescent lamps have introduced a line of energy saving lamps which use a mixture of krypton gas. These lamps are more expensive than regular ones and the maximum energy savings for using them in conventional applications is estimated at only about 20% and, when such lamps are more highly loaded, there is little or no savings in the amount of electrical energy consumed.

So called phantom tubes have been tried. These devices produce no light and serve primarily to complete the circuit when two or more fluorescent tubes are used in series. As such, overall lighted lamp length and wattage of the fluorescent circuit is reduced accordingly. However, the overall efficiency of light production of the fluorescent circuit is also reduced. In addition, these tubes have the appearance of being burned out and thus detract from the pattern of illumination and the aesthetic appearance of the lighting fixtures where used.

More recently, there has been disclosed in U.S. Pat. No. 3,954,316, an electrical apparatus which is designed to modify the electrical circuit of a rapid start fluorescent lighting fixture to reduce power consumption of the fixture. A special D.C. isolation transformer is connected in series with the ballast and one of the lamp cathodes. A capacitor is wired across the primary and secondary coils of the transformer. This concept of isolating the lamp current and controlling it through reactive means is essentially what is taking place in the ballast itself. There are some disadvantages in using this apparatus. For example, the use of a D.C. isolation transformer tends to isolate the attached cathode from the normal starting ground plane which is established by the ballast. Starting potential between this cathode and the body of the fixture is essential to the reliable starting of any rapid start lamp. Moreover, the capacitor is wired across the windings of the isolation transformer and therefore remains charged after power to the fixture is turned off. This situation could prove hazardous to anyone repairing the ballast or lamp circuits. Finally, the use of a single capacitor across the transformer windings can result in significant differences in cathode voltage, depending on how the apparatus is connected in the circuit.

My invention is directed to an electrical device which overcomes the problems mentioned above, and which is safer and more reliable to use.

SUMMARY OF THE INVENTION

Briefly stated, the invention is a device for reducing the current and consequent wattage required by conventional rapid start fluorescent lighting fixtures employing a rapid start, series-type ballast. The device consists of a simple step-up transformer which is mounted exteriorly of the ballast and wired in series with the ballast and one of the lamp cathodes. A resistor and a pair of capacitors are wired across the windings of the transformer.

DESCRIPTION OF THE DRAWINGS

The following description of the invention will be better understood by having reference to the annexed drawing, wherein.

DETAILED DESCRIPTION OF THE DRAWING

Figure 1:
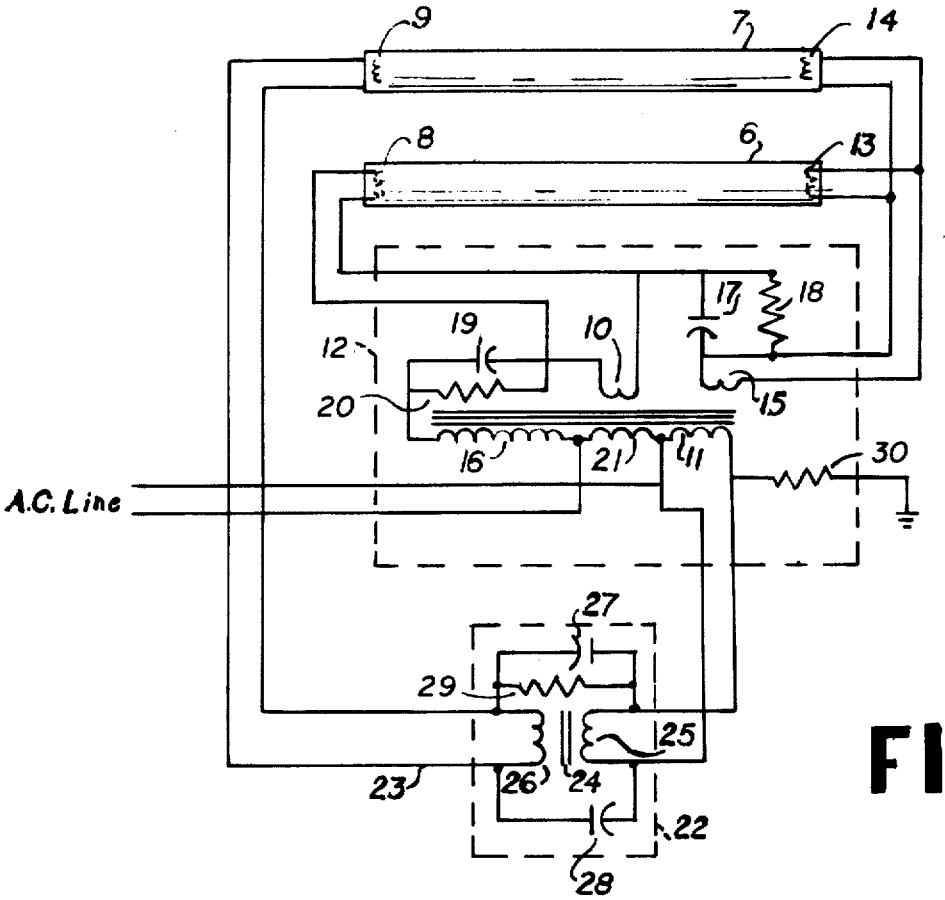
FIG. 1 is a typical electrical circuit diagram including a fluorescent lighting fixture with a series-type rapid start ballast, rapid start lamps and a device of the invention for reducing the power consumption of the fixture.

With reference to FIG. 1, there is shown a typical, rapid start fluorescent lighting fixture 5 comprising a pair of rapid start fluorescent lamps 6, 7 having cathodes 8, 9 which are individually heated by 3.5 volt cathode coils 10, 11 of a conventional two lamp rapid start ballast 12 for starting the first and second lamps 6, 7, in sequence, and then operating them in series. The remaining, opposing cathodes 13, 14 of the lamps 6, 7 are heated, in parallel, off another low voltage cathode coil 15 of the ballast 12. A lack of heat for the cathodes 8, 9, 13, 14 severely shortens the life of the rapid start fluorescent lamps 6, 7. A secondary coil 16 of the ballast 12 provides high voltage to operate lamps 6, 7 in series. A capacitor 17 is wired, in parallel, with the cathode coils 10, 15 to help in the initial operation of the fixture 5. A high value resistor 18 is connected across the capacitor 17. A second capacitor 19 wired, in series, with the secondary coil 16 and cathode 8 of the first lamp 6, serves primarily to limit the flow of electrical current to the lamps 6, 7 to a specified value. A high value resistor 20 is connected across the second capacitor 19. The ballast 12 is supplied with still another primary coil 21 which is in electrical communication with a source of alternating current such as conventional 120-volt house current. The ballast 12, as outlined above, is conventionally encapsulated and sealed in a metal container.

A watt limiter 22, so-called because it reduces the wattage consumed by the fixture 5, is installed in either circuit containing the cathodes 8, 9 of the lamps 6, 7, e.g., the circuit 23 containing the cathode coil 11 and the cathode 9 of the second lamp 7.

The watt limiter 22 consists of (I) A simple step-up transformer 24 having (a) a primary winding 25 which, in this case, is connected in series with the cathode coil 11 of ballast 12, and (b) a secondary winding 26 which is wired in series with the cathode 9 of the second lamp 7; and (II) A pair of conventional capacitors 27, 28 which are wired across the primary and secondary windings 25, 26 of the transformer 24, in series with the ballast 12 and cathode 9 of the second lamp 7; and most importantly (III) A resistor 29 is wired across the primary and secondary windings 25, 26 of the transformer 24. The resistor 29 can be wired in parallel with either of the capacitors 27, 28, but is shown wired across capacitor 27.

The transformer 24 has a step-up ratio of about 1:1.3 between the primary and secondary windings 25, 26 and is utilized to maintain the voltage necessary to properly heat the cathodes of the lamps. The capacitors 27, 28 reduce the current in the circuit and consequent consumption of power by the fixture 5. A single capacitor is normally sufficient, but two are provided to simplify wiring the watt limiter 22 in the circuit containing the ballast and lamps and eliminate any problems which might arise because of the different ways the fixture 5 could be originally wired into the circuit.

The resistor 29 is wired across the primary and secondary windings 25, 26 of the transformer 24 to eliminate any isolation between these windings and place the cathode at the proper ground plane potential as established by a resistor 30 positioned between the ballast 12 and ground. The resistor 29 also acts as a starting aid for the lamp circuit and insures that ionizing current will flow through the lamps. The resistor 29, if properly selected for value and size, can, of itself, reduce the lamp current, but the losses encountered would offset the reduction of the lamp wattage. The value of the resistor 29 is purposely kept high, about 3 megohms, so that little lamp current flows through it and the voltage across it remains at a high value. Thus, most of the current limiting is accomplished through reactance by capacitors 27, 28 which are connected across the primary and secondary windings 25, 26 of the transformer 24. The resistor 29 serves another important function in that it allows the capacitors 27, 28 to discharge when the power is removed from the circuit. If the primary and secondary windings 25, 26 of the transformer 24 were in D.C. isolation, the capacitors 27, 28 would not have a discharge path. This situation could prove hazardous to anyone working on the lamp circuits.

Figure 4:
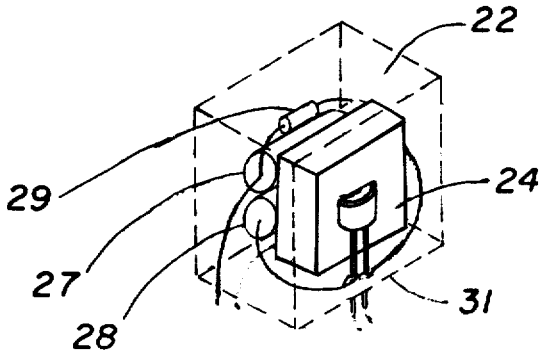
FIG. 4 is a perspective view of a packaged device of the invention consisting of a transformer, two capacitors and a resistor.

For convenience and added safety, the transformer 24, capacitors 27, 28 and resistor 29 are mounted within a solid, rigid housing 31 (FIG. 4) which can be composed of any suitable material, e.g., metal or plastic. The two pairs of wire leads extend from the housing 31 for wiring the watt limiter 22 into the circuit. The watt limiter 22 can utilize other current limiting devices such as choke coils, solid state transistors, etc., provided they are appropriately designed. The combination of capacitors and resistor was found to produce the best results while providing the simplest and most compact unit.

Thus, the lamp current is reduced to correspondingly reduce the wattage consumed by the lamps 6, 7. The resulting illumination of the lamps 6, 7 is lower, but uniform. Moreover, all of the lamps of a series of lighting fixtures used to create a desired pattern of illumination remain lighted, thereby providing a more pleasing and harmonious effect. Lamp wattage is reduced to a greater extent than light output, so that an increase in operating efficiency is achieved. In addition, the temperature at which the ballast operates, is reduced, resulting in improved ballast life.

Figure 2:
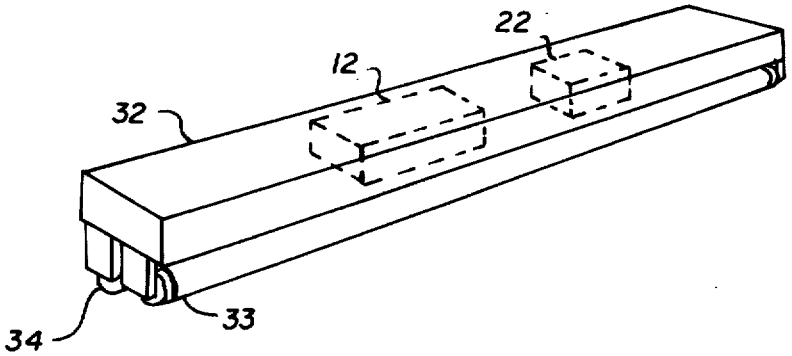
FIG. 2 is a perspective view of a conventional fluorescent fixture with two lamps, a ballast and a device of the invention for reducing the power consumption of the fixture.

With reference to FIG. 2, there is shown a typical fluorescent lighting fixture 32 having two rapid start fluorescent lamps 33, 34, a rapid start fluorescent ballast 12, and a watt limiter 22. This ballast 12 is conventionally mounted within the wiring channel of the fixture 32, as shown. The watt limiter 22 can also be mounted within the wiring channel, or positioned outside and remote from fixture 32, if desired.

Figure 3:
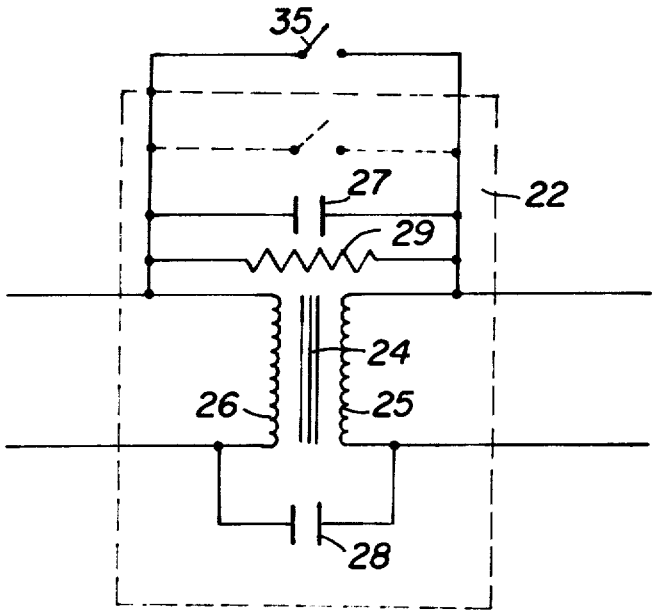
FIG. 3 is an electrical circuit diagram of a modification of a switch used with the device of the invention for reducing power consumption of the fixture.

A possible modification of the watt limiter 22 is shown in FIG. 3. Here, an electronically generated or manual internal or external switch 35 is used to produce two different light levels. Closing the switch 35 acts to short out the capacitors 27, 28 and resistor 29, thereby increasing the light output and wattage to the level provided by the conventional ballast 12 associated with the fixture. Thus, the user would have two levels of light control and subsequent different power consumption, depending on the desired illumination.

Thus, there is provided a device for saving electrical energy while maintaining a uniform pattern of illumination by keeping all of the lamps of the fluorescent fixtures lighted, but at a lower level of illumination. Tests showed that best results were achieved with capacitors 27, 28 each having a capacitance in the broad range of from 1 to 8 microfarads and in the preferred narrower range of from 1 to 6 microfarads.

A typical two-lamp, rapid start fluorescent fixture was found to consume, for example, about 84 watts while giving off about 960 foot candles of illumination, or about 11.4 foot candles per watt, while for the same period of time, the same fixture with a watt limiter 22, having capacitors of 2.5 microfarads capacitance each, was found to consume about 53 watts while giving off about 730 foot candles of illumination, or about 13.8 foot candles per watt, an increase of over 20 percent in what might be viewed as the efficiency at which the fixture operates per watt expanded.

What is claimed is:

1. A device which is wired in series between a rapid start ballast and cathode of one of the lamps of a coventional rapid start fluorescent lighting fixture to reduce the wattage consumed by the lamp, comprising:

a housing;

at least two pairs of leads extending from the housing; and including a pair of input leads and a pair of output leads;

means disposed in the housing and wired in series with said at least two pair of leads for reducing electrified current flowing to the fixture without reducing the voltage;

a step-up transformer having a primary winding connected to the input leads and a secondary winding connected to the output leads;

a first capacitor connecting one input lead to one output lead;

a second capacitor, similar to the first capacitor, connecting the other input lead to the other output lead;

a resistor connected in parallel with one capacitor.

2. The device of claim 1, wherein the capacitance of each of the capacitors is in the range of from 0.5 to 10 microfarads and the resistor has a resistance in the range of from 0.001 to 3 megohms.

3. The device of claim 2, wherein the capacitors have a total capacitance of from 4 to 6 microfarads.

4. The device of claim 1, wherein the capacitance of each of the capacitors is equal and in the range of from 1 to 8 microfarads.

5. The device of claim 4, wherein the capacitors have a total capacitance in the range of from 4 to 6 microfarads.

6. A watt limiting device wired in combination with;

a rapid start fluorescent lighting fixture having a plurality of rapid start lamps and a rapid start ballast, with each of the lamps having a pair of opposing cathodes;

a step-up transformer disposed externally of the ballast and wired in series with the ballast and a cathode of one of the lamps, said transformer having a primary winding and a secondary winding, with two pairs of winding ends;

a pair of capacitors disposed externally of the ballast, one of said pair of capacitors connecting one of the primary winding ends to one secondary winding end, the second of said pair of capacitors connecting the other primary winding end to the other secondary winding end;

a resistor wired in parallel with one of the capacitors, disposed externally of the ballast.

7. The combination of claim 6, wherein the capacitors are equal in capacitance and each have a capacitance in the range from 1 to 8 microfarads.

8. The combination of claim 7, wherein the capacitors have a total capacitance in the range of from 4 to 6 microfarads.

9. A method of reducing the consumption of power of a rapid start fluorescent lighting fixture having a plurality of rapid start lamps and a conventional ballast, while uniformally lighting the lamps; comprising the steps of wiring a step-up transformer in series with the ballast and one of the lamps, said transformer having a primary winding and a secondary winding, connecting a first capacitor between one primary winding end and one secondary winding end, connecting a second capacitor between the other primary winding end and the other secondary winding end, and connecting a resistor in parallel with one of the capacitors.

10. The method of claim 9, wherein the capacitance of the capacitors are equal and each is in the range of from 0.5 to 10 microfarads.

11. The method of claim 10, wherein the resistance of the resistor is in the range of from 0.001 to 3 megohms.

* * * * *